US009854662B2

(12) United States Patent
Mishin

(10) Patent No.: US 9,854,662 B2
(45) Date of Patent: Dec. 26, 2017

(54) HYBRID LINEAR ACCELERATOR WITH A BROAD RANGE OF REGULATED ELECTRON AND X-RAY BEAM PARAMETERS INCLUDES BOTH STANDING WAVE AND TRAVELING WAVE LINEAR SECTIONS FOR PROVIDING A MULTIPLE-ENERGY HIGH-EFFICIENCY ELECTRON BEAM OR X-RAY BEAM USEFUL FOR SECURITY INSPECTION, NON-DESTRUCTIVE TESTING, RADIATION THERAPY, AND OTHER APPLICATIONS

(71) Applicant: VAREX IMAGING CORPORATION, Salt Lake City, UT (US)

(72) Inventor: Andrey Mishin, North Andover, MA (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 96 days.

(21) Appl. No.: 15/068,355

(22) Filed: Mar. 11, 2016

(65) Prior Publication Data

US 2017/0265293 A1 Sep. 14, 2017

(51) Int. Cl.
*H05H 9/00* (2006.01)
*H05H 9/02* (2006.01)
(Continued)

(52) U.S. Cl.
CPC ..... *H05H 9/047* (2013.01); *H05H 7/02* (2013.01); *H05H 9/02* (2013.01); *H01J 29/48* (2013.01); *H01J 35/14* (2013.01)

(58) Field of Classification Search
CPC ..... H01J 29/48; H01J 35/14; H05H 7/02; H05H 9/02; H05H 9/047
See application file for complete search history.

(56) References Cited

U.S. PATENT DOCUMENTS 2,920,228 A 1/1960 Ginzton
3,019,400 A 1/1962 Garver
(Continued)

FOREIGN PATENT DOCUMENTS

CN 1455635 11/2003
CN 202019491 U 10/2011
(Continued)

OTHER PUBLICATIONS

Armistead et al., "Microwave Semiconductor Switch," Diamond Ordnance Fuze Labs, Washington 25, D.C., Proceedings of the IRE Dec. 1956, p. 1875.
(Continued)

*Primary Examiner* — Mark R Gaworecki
(74) *Attorney, Agent, or Firm* — Cozen O'Connor

(57) ABSTRACT

A Hybrid (SW+TW) Linear Accelerator is disclosed having high beam efficiency and broad energy regulation that is useful for security inspection, non-destructive testing, radiotherapy, and electron beam irradiation of objects. The Hybrid Linear Accelerator (LINAC) provides superior energy regulation, and includes a reversed RF power distribution which substantially improves RF power utilization, thereby eliminating need for an output RF load, and ensuring broad electron beam energy regulation operating in a broad range of input RF power, thereby efficiently running at a variety of input electron beam current intensities at high efficiency. The Hybrid LINAC may be equipped with a fast and/or slow phase shifter and/or a power regulator having a phase shifter and a current regulator, while operating much more efficiently than known LINACS. The Hybrid LINAC permits efficient operation without an external magnetic field, thereby avoiding use of a power-consuming solenoid, consequently reducing cost of production, operation, and maintenance.

20 Claims, 5 Drawing Sheets

(51) Int. Cl.

| | |
|---|---|
| ***H05H 9/04*** | (2006.01) |
| ***H05H 7/02*** | (2006.01) |
| *H01J 35/14* | (2006.01) |
| *H01J 29/48* | (2006.01) |

(56) References Cited

U.S. PATENT DOCUMENTS

| | | | | |
|---|---|---|---|---|
| 3,070,726 | A | 12/1962 | Mallory | |
| 4,118,653 | A | 10/1978 | Vaguine | |
| 4,286,192 | A | 8/1981 | Tanabe et al. | |
| 5,661,377 | A | 8/1997 | Mishin et al. | |
| 6,864,633 | B2 | 3/2005 | Trail et al. | |
| 7,538,325 | B2 | 5/2009 | Mishin et al. | |
| 8,942,351 | B2 | 1/2015 | Cheung et al. | |
| 2003/0141448 | A1 | 7/2003 | Symons | |
| 2005/0205772 | A1* | 9/2005 | Zavadtsev | G21K 5/04 250/251 |
| 2007/0274445 | A1* | 11/2007 | Zavadtsev | G01N 23/04 378/57 |
| 2007/0296530 | A1 | 12/2007 | Heisen et al. | |
| 2008/0211431 | A1 | 9/2008 | Mishin et al. | |
| 2014/0185775 | A1 | 7/2014 | Tang et al. | |
| 2015/0338545 | A1 | 11/2015 | Arodzero et al. | |
| 2016/0014877 | A1 | 1/2016 | Sugahara et al. | |

FOREIGN PATENT DOCUMENTS

| | | |
|---|---|---|
| KR | 20150055439 | 5/2015 |
| SU | 1374454 | 2/1988 |
| SU | 1119599 | 3/1988 |
| WO | WO 2016/091940 | 6/2016 |

OTHER PUBLICATIONS

Uebele, G.S., "High-speed, Ferrite Microwave Switch," 1957 IRE National Convention Record, vol. 5, pt. 1, pp. 227-234, Proceedings IRE Transitions on Microwave Theory and Techniquies, Jan. 1959, p. 73-82.

Haimson, J., "Some Aspects of Electron Beam Optics and X-Ray Production with the Linear Accelerator," IRE Transitions on Nuclear Science 10 1109 TNS2431598, pp. 32-49, 1962.

Vaguine, V.A. "Electron Linear Accelerator Structures and Design for Radiation Therapy Machines," IEEE Transistions on Nuclear Science, vol. NS-28, No. 2, pp. 1884-1888, Apr. 1981.

Segall, S.B., "Hybrid Accelerator Design for a Free Electron Laser," IEEE Transitions on Nuclear Science, vol. NS-32, No. 5, Oct. 1985.

Miller et al., "Comparison of Standing-Wave and Traveling-Wave Structures," Presented at the Stanford Linear Accelerator Conference, Stanford, California on Jun. 2-6, 1986.

O'Shea et al., RF Design of the UCLA/INFN Hybrid SW/TW Photoinjector, Advances Accelerator Concepts (1995), Proceedings, pp. 1-7, Sep. 22, 2006.

Bigolas et al., "The SW Accelerating Structure of Variable Energy Electron Linac for Medical Application," Proceedings of the 2001 Particle Accelerator Conference, Chicago, pp. 2790-2792, 2001.

Hanna, S., "Review of Energy Variation Approaches in Medical Accelerators," Proceedings of EPAC08, Genoa, Italy, pp. 1797-1799, 2008.

Fukasawa et al., "Beam Dynamics and RF Cavity Design of a Standing/Traveling-Wave Hybrid Photoinjector for High Brightness Beam Generation," Proceedings of PAC09, Vancouver, BC, Canada pp. 4434-4436, 2009.

Zavadstev et al., "A Dual-Energy Cargo Inspection System," Instruments and Experimental Techniques 54(2), 2011, Proceedings of 2011 Particle Accelerator Conference, New York, NY, USA, p. 241-248.

Kutsaev et al., "Hybrid Electron Linac Based on Magnetic Coupled Accelerating Structure," Proceedings of 2011 Particle Accelerator Conference, New York, NY USA, pp. 2136-2138, 2011.

Matsievskiy et al., "Hybrid Electron Linac with Standing and Travelling Wave Accelerating Sections," Proceedings of IPAC, 2016, Busan, Korea, pp. 1791-1793.

Rosenzweig et al., "Bean Dynamics in a Hybrid Wave Traveling Wave Photoinjector,"UCLA Dept. of Physics and Astronomy, Los Angeles, CA, 2006, (7 pages).

Kutsaev et al., "Design of Hybrid Electron Linac with Standing Wave Buncher and Traveling Wave Structure," Nuclear Instruments and Methods in Physics Research A, 636 (2011), pp. 13-30.

International Search Report and Written Opinion dated May 11, 2017 issued in International Patent Application No. PCT/US2017/021895.

Pirozhenko, "Efficient Traveling-wave Accelerating Structure for Linear Accelerators," EPAC 2008, Genoa, Italy, 11$^{th}$ European Particle Accelerator Conference, pp. 2746-2748, 2008.

* cited by examiner

HYBRID LINEAR ACCELERATOR WITH A BROAD RANGE OF REGULATED ELECTRON AND X-RAY BEAM PARAMETERS INCLUDES BOTH STANDING WAVE AND TRAVELING WAVE LINEAR SECTIONS FOR PROVIDING A MULTIPLE-ENERGY HIGH-EFFICIENCY ELECTRON BEAM OR X-RAY BEAM USEFUL FOR SECURITY INSPECTION, NON-DESTRUCTIVE TESTING, RADIATION THERAPY, AND OTHER APPLICATIONS

FIELD

This invention relates generally to linear accelerators for providing electron beams or x-ray beams, and particularly to such linear accelerators including a standing wave section, and a traveling wave section in collinear relationship with the standing wave section.

BACKGROUND

Linear Accelerators (also called "LINACS") are widely used for a variety of tasks in a broad range of applications, including industrial applications such as Non-Destructive Testing (NDT), Security Inspection (SI), Radiotherapy (RT), electron beam processing—sterilization, and polymer curing, for example. Both accelerated electron beams, and Bremsstrahlung X-ray beams (collectively called "radiation beams" (RB)) generated by such electron beams striking a conversion target at the end of an accelerating channel, are used for various tasks. The type of RB selected is typically determined by the specific application and its requirements. In many applications, the requirements include energy variation and dose rate variation of the RB, including broad RB energy variation, for example, from 0.5 MeV to a maximum energy, which typically does not exceed 10 MeV due to neutron production and activation problems. However, in some known cases, it can reach as high as 12 MeV, 15 MeV, 20 MeV, or even higher energies. Those familiar with the art are well aware that a LINAC is a sophisticated tool that does not always run efficiently, or does not perform at all over such a broad RB operating energy range.

A LINAC includes a plurality of cavities, which gradually increase in length in the direction of the electron beam propagation to keep the particles in the right accelerating phase while their velocity increases. Once electron velocity reaches nearly the speed of light, the period of the structure and the shape of the accelerating cells usually remain the same until the end of the accelerator.

The front irregular section of the LINAC where electron velocities change substantially (from about 20% to 95% of the speed of light), and where the electrons are grouped together as a stream of bunches of electrons, is typically called the "buncher". The buncher is responsible for forming the relativistic electron beam, which then enters the regular periodic part of the LINAC structure, called the "accelerator", where the velocity of the electrons does not change substantially, while they reach higher energies above 1 MeV, and up to the N×10 MeV range or higher (where N is an integer 1, 2, . . . N).

An important parameter used for defining efficiency of the buncher is called "capture", which presents a percentage of the particles captured by the accelerating fields, and synchronously accelerated to the required energy with respect to a total number of particles injected into the structure. Capture is very sensitive to the accelerating field distribution in the buncher. While one attempts regulating output energy of the produced RB by varying input RF power into the LINAC, the structure of the fields in the buncher change, and the electron beam current in the accelerating channel may reduce substantially due to degradation of capture in the buncher, thereby reducing intensity of the produced RB.

The same may be true for regulating the RB energy via switching of the injected electron beam pulse current without optimizing power and field distribution along the linear accelerator. The optimization is especially important for the magnetron-driven LINACS, which represent most of the commercial markets, and even more so, for the higher frequency LINACS (designed to operate with an X-band power source, for example) where lack of the input RF power generated by the best commercially available X-band magnetrons for a given task exists in most, if not all cases (so-called "power hungry" mode of operation).

A traditional SW LINAC has been described in multiple references, and is presented schematically in FIG. 1. RF power is provided by the RF power source (1) (which in most cases, is a magnetron or a klystron). The RF power propagates through an RF Transmitting Waveguide (2) and a High Power Circulator (3) to the Input RF Coupler (4), which is configured to match impedance of the external and internal RF circuit so as to minimize power reflections at the operating RF frequency. High Power Circulator (3) serves to prevent reflected power from propagating back to the RF source (1). It is called "High Power" rather than "Low Power" (see below) because it is adapted for the maximum possible power generated by the RF source. Therefore, most of the RF power from the RF source (1) enters the LINAC, which usually includes a plurality of single RF cavities coupled together in various ways depending on the RF structure design. FIG. 1 shows a LINAC that has two single RF structures coupled together.

The LINAC of FIG. 1 can be divided into two parts—a Standing Wave (SW) Buncher (5) and a Standing Wave (SW) Accelerator Section (23). The SW buncher (5) contains a sequence of cavities, which are different in length so as to maintain proper phase shift between the accelerating fields in the neighboring cells accommodating the gradually increasing electron velocity, which rapidly increases to relativistic values (close to the speed of light). The electron velocity becomes nearly constant in the Accelerating Section (23), so all the cells are the same in length.

The single RF cavity of the Input RF Coupler (4) is also part of the LINAC RF structure. In the case of the SW LINAC, this Input RF coupler (4) can be positioned virtually anywhere along the LINAC, but usually, it is placed somewhere after the SW Buncher (5) and before the SW Accelerator Section (23). In the LINAC of FIG. 1, the SW Buncher (5), the Input RF Coupler (4), and the SW Accelerator Section (23) together provide the single RF-coupled accelerating structure of the LINAC. The RF power is distributed among the LINAC cavities in accordance with the LINAC configuration and its RF properties, forming an RF field distribution responsible for accelerating the charged particles, for example, the electrons. Further, we will use "electrons" as the charged particles, and provide an "electron beam", as this LINAC configuration is mostly applicable to accelerating electrons.

An Electron Beam (10) is formed in an Electron Gun (11), which can operate in a range of high voltages N×(1, 2, 3 . . . 100) kV, forming an electron beam (10) of necessary small diameter so as to enter the LINAC RF structure. The Electron Beam (10) gains energy while propagating through the RF fields of the LINAC cavities (5) and (23), and after it exits the RF accelerating structure, the Electron Beam (10) is extracted outside the vacuum envelope through a vacuum-tight thin foil for electron beam applications, or it strikes a heavy metal target to generate bremsstrahlung (X-rays) if this is the requirement for the output RB (12).

In some cases, an optional external Magnetic System (13) (such as a focusing solenoid or a permanent periodic magnet (PPM) system) is used, which may also include steering coils, bending magnets, etc. for correction of beam positioning inside the LINAC, or at its exit via Electron Beam Window or Conversion Target (12). Use of an external focusing system is undesirable because it increases complexity, power consumption, and consequently increases the cost of the LINAC system. In SW LINAC systems, use of a Magnetic System (13) can be avoided, but in TW LINACS, it is necessary in most cases, especially for the Buncher portion of a LINAC. We are not showing a TW LINAC diagram since the effects of power regulation are quite similar, and in the case of broad energy regulation, these effects are devastating to electron beam quality, just as in a SW LINAC.

To regulate energy in such a single RF feed from RF Source (1) and single SW Accelerator section (23) LINAC, field amplitude in the LINAC RF structure must be changed due to beam loading, or due to input power regulation. Analysis of the LINAC performance (in the absence of an external magnetic focusing field produced by a solenoid or a periodic permanent magnet (PPM) focusing system) is shown in the graph of FIG. 2, where a comparison is provided of a theoretical LINAC load line in the first approximation (Energy, MeV) to a load line obtained as a result of computer simulations of beam dynamic for the same SW LINAC (using Parmela computer code). The graph of FIG. 2 also presents the corresponding dose rate curve based on the first linear load line (Dose Rate, R/min@1 m) and the other dose rate dependency that corresponds to the load line based on Parmela calculations (Parmela/Dose). The effect of beam dynamics on output radiation beam characteristics is evident. A reduced complexity and reduced cost LINAC is always preferred, and a SW LINAC can be designed to avoid use of the external focusing much easier than a TW LINAC. The TW LINAC, however, delivers some properties superior to a SW LINAC, but it usually requires a focusing solenoid. A TW guide principal behavior will be similar to that for the SW, described above.

Due to a common deficit of RF power, the LINACS are usually designed for near maximum optimal output energy, where the dose rate is at its maximum defined by a well-known empirical ratio as follows:

$$P=70\times I\times W^{n}, \quad (1)$$

where:

P is the Bremsstrahlung dose rate at 1 meter from a heavy metal conversion target, in R/min;

I is the average electron beam current striking the target, in mA;

W is the electron beam energy, in MeV; and n is a parameter that varies with energy (in several MeV range it is approximately 2.7).

For LINACS using an electron beam in a broad energy range, it is important to increase capture and efficiency at lower energy, thereby increasing accelerated beam current and electron beam dose rate of the RB. In the cases where LINACS are equipped with a conversion target so as to produce bremsstrahlung, the conversion dose rate is proportional to current, and nearly to a cube of energy. Consequently, lower energy operation of the LINAC at higher beam current becomes even more important. As we have already stated, efficient operation at lower energy is difficult to achieve, if a LINAC is designed for providing a beam at maximum energy at a given beam current to obtain the best RB output.

In the literature, one can find a variety of ways proposed by authors skilled in the art to configure LINACS such that they operate better when energy is regulated, both in a "fast" and "slow" mode of changing the beam energy.

One of the first hybrid LINACS has been proposed in patent SU 1374454 A1, where a disadvantage remains in that the SW buncher is a section of disk loaded waveguide, and it is not as efficient as other structures. In addition, regulation of energy is hardly possible with high efficiency, due to change of the fields along all single accelerating structures while regulating power or beam current.

An original and efficient power regulation scheme is proposed in patent SU 1119599, where a several section TW LINAC is powered in a reversed sequence, increasing effective utilization of RF power along the LINAC. A disadvantage of this approach is that a TW section is not efficient at low fields, and at low electron beam velocities in the buncher section.

In U.S. Pat. No. 2,920,228 a LINAC with two TW sections, and a parallel RF feed is described. This arrangement has a disadvantage in that the acceleration efficiency is low due to having a TW accelerating structure, and due to the high complexity of the arrangement.

U.S. Pat. No. 3,070,726 describes a TW LINAC with two TW sections, and a prebuncher. The TW sections are powered in series, and contain a phase shifter and a power adjustment RF circuit. This TW LINAC has a complex circuit, and it does not achieve maximum efficiency of acceleration.

U.S. Pat. No. 4,118,653 proposes a TW buncher section cooperative with an SW accelerating section so as to increase the accelerating gradients in the second section. In this configuration, bunching of the beam is performed in a lower shunt impedance structure, which does not allow the LINAC to operate efficiently, and usually, an external focusing coil is required around the first section to achieve the required performance.

U.S. Pat. No. 4,286,192 describes a method of regulating energy using shorts in the side cavities of the SW structure. Some disadvantages of this method are that the mechanical adjustments are done in the accelerator vacuum envelope, and the energy range is narrow.

Chinese Patent No. CN202019491U discloses a side-coupled SW accelerator that adjusts the electron beam energy by adjusting the accelerating gradient of each of two segments of accelerating tubes. However, this approach too has disadvantages in that the accelerator has a large width, the microware feeding system is complex, and it cannot provide electron beams of low energy (≤1 MeV).

US 20140185775 A1 patent describes a two section standing wave electron LINAC with continuously adjustable energy for medical imaging and other medical applications, as an alternative to X-ray tubes. The disadvantages of this arrangement include that two SW sections are used with a parallel input circuit, and the LINAC is very sensitive to beam loading, so both sections need to be tuned with high precision to match the resonant frequencies for a maximum energy gain operation, and the LINAC may not produce maximum possible dose rate in broad range of its parameters.

U.S. Pat. No. 8,942,351 B2 patent describes a TW LINAC with electron beam energy regulation using switching electron beam current, and therefore setting different beam current loading points in the LINAC. This approach has several disadvantages, the first being similar to the one illustrated in FIG. 1, where optimization of beam dynamics and capture in the TW LINAC is difficult to do at various field distributions due to a beam loading effect. Also, an external solenoid is required for beam focusing, and the remaining RF power after accelerating is complete is lost in an RF load, which has to be used to ensure a TW operation regime.

SUMMARY

A combination of a hybrid linear accelerator (LINAC) including collinear standing wave (SW) and traveling wave (TW) sections with an energy and dose switching method, or a combination of various energy switching methods is used for optimization of the output beam energy and dose rate at various energy values. In particular, a combination of the hybrid SW and TW sections, connected via RF waveguides in parallel or in series, in direct or a reverse sequence with a gas-filled, a ferrite, or any other RF switch (for example, the one used in radar circuit designs; some are commercially available) can be used in a transmitting waveguide to redirect and redistribute RF power between sections of the LINAC and/or change phase shift between these sections. The invention provides electron beams or x-rays in a broad range of energy and dose "slowly", when time of the variation is substantially greater than pulse length and/or pulse repetition period, or "fast", i.e., within times comparable to the latter, including variation within a pulse, fast pulse-to-pulse energy and dose switching (collectively called "fast switching") with high or substantially increased efficiency in this broad range of beam parameters, while keeping the switch outside linear accelerator vacuum envelope.

The invention provides a hybrid SW+TW LINAC having superior energy regulation, the hybrid SW+TW LINAC including an novel reversed RF power distribution in its preferred embodiment, which substantially improves RF power utilization, thereby eliminating need for an output RF load, ensuring broad electron beam energy regulation operating in a broad range of input RF power, thereby efficiently running at a variety of input electron beam current intensities at high efficiency. This LINAC may be equipped with a fast and/or slow phase shifter and/or power regulator combination of phase shifter, combined with current regulation, but operating much more efficiently than known LINACS. The hybrid LINAC of the invention permits efficient operation without an external magnetic field, thereby avoiding use of a power-consuming solenoid and its power supply, consequently reducing cost of production, operation, and maintenance of the broad RB regulated LINAC. In addition, presence of the SW section permits Automatic Frequency Control (AFC) of the magnetron in a traditional more simple and highly stable way, using forward and reflected resonant signals from the SW section (unlike when using only a TW section in the LINAC, which is more broad band).

The present invention utilizes a hybrid LINAC arrangement usually including two LINAC sections (while more separate sections can be used for further optimization). Preferably, the two LINAC sections are respectively an SW buncher and a TW accelerator (SW+TW). The invention in its preferred embodiment is a hybrid, SW+TW LINAC with various power input RF circuits, which can include "slow" and/or "fast" phase shifters and/or power regulators, for example, with a "reversed" RF power feeding sequence shown in FIG. 3, where the SW buncher replaces the RF load commonly used in a LINAC to absorb the remaining power coming out of TW LINAC output coupler, substantially increasing, therefore, the LINAC efficiency. The RF power from an RF source, commonly, a magnetron or a klystron, or any other available RF source is injected into the input coupler of TW section, following and co-linear with the SW buncher. The hybrid LINAC of the present invention can ultimately become an electron or X-ray beam source, depending on its application, and it includes a diode, a triode, or any other type of electron source or electron gun, where the electron beam is formed, usually, at n×10 keV, and in its first embodiment, it is injected into the RF structure of the SW buncher, where the electron bunches are formed and accelerated so as to bring the electron beam energy into the several MeV range, typically, around 1 MeV, to ensure that bunching is nearly complete and the electron beam becomes close to being fully relativistic, typically, 0.85 to 0.95 times the speed of light. Then, in this first embodiment, the electron beam enters the TW section or sections of the LINAC and accelerated to a higher output energy with practical values from 4 to 12 MeV, and sometimes to a higher energy. Finally, the accelerated electron beam strikes a bremsstrahlung conversion target to produce X-rays, or it is passed through an output window, usually, a thin metal foil, extracted therefore, from the vacuum envelope into air or a different environment, such as a different gas or a liquid, water, for example, depending on the application and the LINAC configuration. In most cases, in the SW buncher it is possible to use RF fields to focus and transport the electron beam to the next stage, thereby avoiding use of the external magnetic focusing system for this buncher, and, possibly for the remaining accelerator structure. The LINAC controls and modulator may or may not provide the supplemental means of regulating electron beam current and/or input RF power so as to support optimization of the LINAC in a broad range of its parameters as described above. The LINAC configuration of the invention can include the fast and/or slow phase shifters providing the required energy and power distribution in the LINAC. The other invention embodiments can include a combination of various SW and TW sections with electrical and/or magnetic coupling in a variety configurations and sequences, with a parallel RF circuit and/or an RF circuit configured in series.

The hybrid LINAC of the invention can be used for vehicle screening and various cargo screening for security and trade manifest verification (collectively called Security Inspection, abbreviated as SI), non-destructive testing (NDT), and radiotherapy (RT), primarily, but it can be used in some other applications, such as electron beam irradiation of objects of various thicknesses and shapes, such as for curing of composites and electron beam sterilization, for example.

A general aspect of the invention is a Hybrid LINAC with high beam efficiency and broad energy regulation for security inspection, non-destructive testing, radiotherapy, and electron beam irradiation of objects. The Hybrid LINAC includes: an electron gun configured to provide an input beam of electrons; a standing wave linear accelerator section (SW Buncher) configured to receive the input beam of electrons and accelerate the electrons, the SW Buncher including an SW Input RF Coupler, the SW Buncher providing an intermediate beam of accelerated electrons; a traveling wave linear accelerator section (TW accelerator) configured to receive the intermediate beam of accelerated electrons, and to further increase the momentum and energy of the accelerated electrons, the TW accelerator including a TW Input RF Coupler and a TW Output RF Coupler, the TW accelerator providing an output beam of electrons; a drift space configured to provide RF decoupling between the SW buncher and the TW accelerator, while also permitting transit of the intermediate beam of accelerated electrons from the SW buncher to the TW accelerator; an RF source configured to provide RF energy to the TW accelerator via a first RF Transmitting Waveguide and the TW Input RF Coupler; and a second RF Transmitting Waveguide including at least one of: a Switch, a Phase Shifter, and a Power Adjuster, the second RF Transmitting Waveguide being cooperative with both the TW Output RF Coupler and the SW Input RF Coupler, the second RF Transmitting Waveguide allowing the SW Buncher to serve as an adjustable resonant load so as to provide broad energy regulation of the output beam of electrons, the second RF Transmitting Waveguide also enabling the SW Buncher to be fed with RF power remaining after attenuation in the TW accelerator so as to provide high beam efficiency of the output beam of electrons.

In some embodiments, the standing wave linear accelerator section (SW Buncher) is cooperative with a first external magnetic system.

In some embodiments, the traveling wave linear accelerator section (TW accelerator) is cooperative with a second external magnetic system.

In some embodiments, the first RF Transmitting Waveguide includes a High Power Circulator so as to prevent reflected RF power from propagating back to the RF source.

In some embodiments, the second RF Transmitting Waveguide includes a Low Power Circulator so as to prevent reflected RF power from propagating back to the TW accelerator.

In some embodiments, broad energy regulation of the output beam of electrons provides energy regulation from 0.5 MeV to maximum LINAC energy.

In some embodiments, the Hybrid LINAC further includes at least one of: an electron beam window and a conversion target for producing Bremsstrahlung radiation.

Another general aspect of the invention is a Hybrid LINAC with high beam efficiency and broad energy regulation for security inspection, non-destructive testing, radiotherapy, and electron beam irradiation of objects. This Hybrid LINAC includes: an electron gun configured to provide an input beam of electrons; a standing wave linear accelerator section (SW Buncher) configured to receive the input beam of electrons and accelerate the electrons, the SW Buncher including an SW Input RF Coupler, the SW Buncher providing an intermediate beam of accelerated electrons; a traveling wave linear accelerator section (TW accelerator) configured to receive the intermediate beam of accelerated electrons, and to further increase the momentum and energy of the accelerated electrons, the TW accelerator including a TW Input RF Coupler and a TW Output RF Coupler, the TW accelerator providing an output beam of electrons; a drift space configured to provide RF decoupling between the SW buncher and the TW accelerator, while also permitting transit of the intermediate beam of accelerated electrons from the SW buncher to the TW accelerator; an RF Splitter configured to receive RF energy, and to bifurcate the RF energy; an RF source configured to provide RF energy to the RF splitter via a first RF Transmitting Waveguide, the RF Splitter providing a first portion of the bifurcated RF energy to the SW Buncher via a second RF Transmitting Waveguide and the SW Input RF Coupler, the second RF Transmitting Waveguide also enabling the SW Buncher to be fed with RF power not used by the TW Accelerator so as to provide high beam efficiency of the output beam of electrons; and at least one of a Switch, a Phase Shifter, and a Power Adjuster, cooperative with both the RF Splitter and the TW Input RF Coupler via a third RF Transmitting Waveguide, the at least one of a Switch, a Phase Shifter, and a Power Adjuster being capable of redistributing RF power between the SW Buncher and the TW Accelerator, and/or changing phase relationship between the SW Buncher and the TW Accelerator, thereby allowing the TW Accelerator to serve as an adjustable resonant load so as to provide broad energy regulation of the output beam of electrons.

In some embodiments, the standing wave linear accelerator section (SW Buncher) is cooperative with a first external magnetic system.

In some embodiments, the traveling wave linear accelerator section (TW accelerator) is cooperative with a second external magnetic system.

In some embodiments, the first RF Transmitting Waveguide includes a High Power Circulator so as to prevent reflected RF power from propagating back to the RF source.

In some embodiments, the Hybrid LINAC further includes: a Matched RF Load, cooperative with the TW Output RF Coupler, matched so as to absorb RF power remaining after acceleration in the TW Accelerator.

In some embodiments, broad energy regulation of the output beam of electrons provides energy regulation from 0.5 MeV to maximum LINAC energy.

In some embodiments, the Hybrid LINAC further includes at least one of: an electron beam window and a conversion target for producing Bremsstrahlung radiation.

Another general aspect of the invention is a Hybrid LINAC with high beam efficiency and broad energy regulation for security inspection, non-destructive testing, radiotherapy, and electron beam irradiation of objects, where the Hybrid LINAC includes: an electron gun configured to provide an input beam of electrons; a standing wave linear accelerator section (SW Buncher) configured to receive the input beam of electrons and accelerate the electrons, the SW Buncher providing an intermediate beam of accelerated electrons; a traveling wave linear accelerator section (TW accelerator) configured to receive the intermediate beam of accelerated electrons, and to further increase the momentum and energy of the accelerated electrons, the TW accelerator including a TW Output RF Coupler, the TW accelerator providing an output beam of electrons; a Hybrid RF Coupler configured to provide RF coupling between the SW buncher and the TW accelerator, while also permitting transit of the intermediate beam of accelerated electrons from the SW buncher to the TW accelerator; an RF source configured to provide RF energy to both the SW Buncher and the TW accelerator via an RF Transmitting Waveguide cooperative with the Hybrid RF Coupler; and a Matched RF Load cooperative with at least one of a Switch, a Phase Shifter, and a Power Adjuster, the Matched RF Load also being cooperative with the TW Output RF Coupler, the Matched RF Load being matched so as to absorb RF power remaining after acceleration in the TW Accelerator in accordance with the at least one of the Switch, the Phase Shifter, and the Power Adjuster, thereby allowing the TW Accelerator to serve as an adjustable resonant load so as to provide broad energy regulation of the output beam of electrons, and so as to provide high beam efficiency of the output beam of electrons.

In some embodiments, the standing wave linear accelerator section (SW Buncher) is cooperative with a first external magnetic system.

In some embodiments, the traveling wave linear accelerator section (TW accelerator) is cooperative with a second external magnetic system.

In some embodiments, the first RF Transmitting Waveguide includes a High Power Circulator so as to prevent reflected RF power from propagating back to the RF source.

In some embodiments, broad energy regulation of the output beam of electrons provides energy regulation from 0.5 MeV to maximum LINAC energy.

In some embodiments, the Hybrid LINAC further includes at least one of: an electron beam window and a conversion target for producing Bremsstrahlung radiation.

BRIEF DESCRIPTION OF THE DRAWINGS

For a fuller understanding of the invention, reference is made to the following Detailed Description, taken in conjunction with the accompanying drawings, in which.

DETAILED DESCRIPTION

Figure 1:
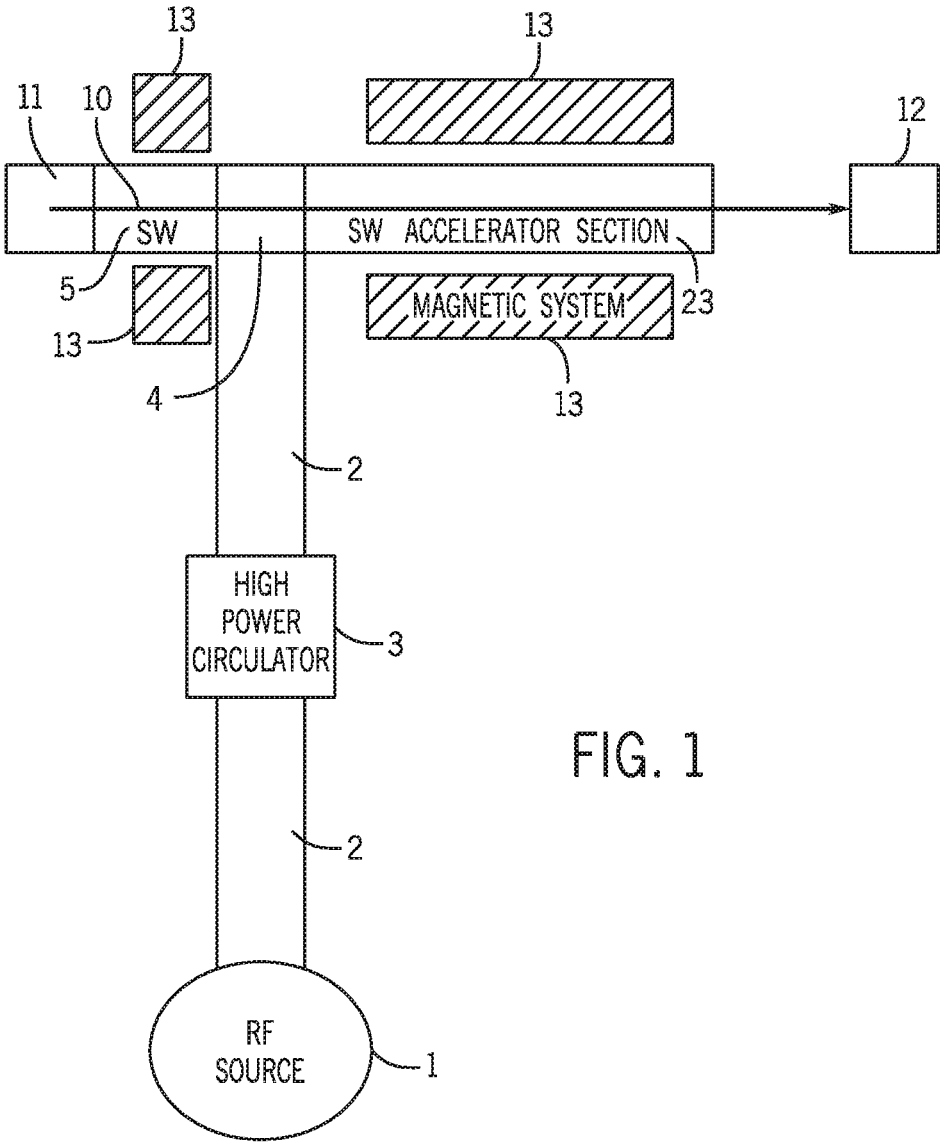
FIG. 1 is a schematic diagram of a traditional SW linear accelerator (LINAC).
Figure 2:
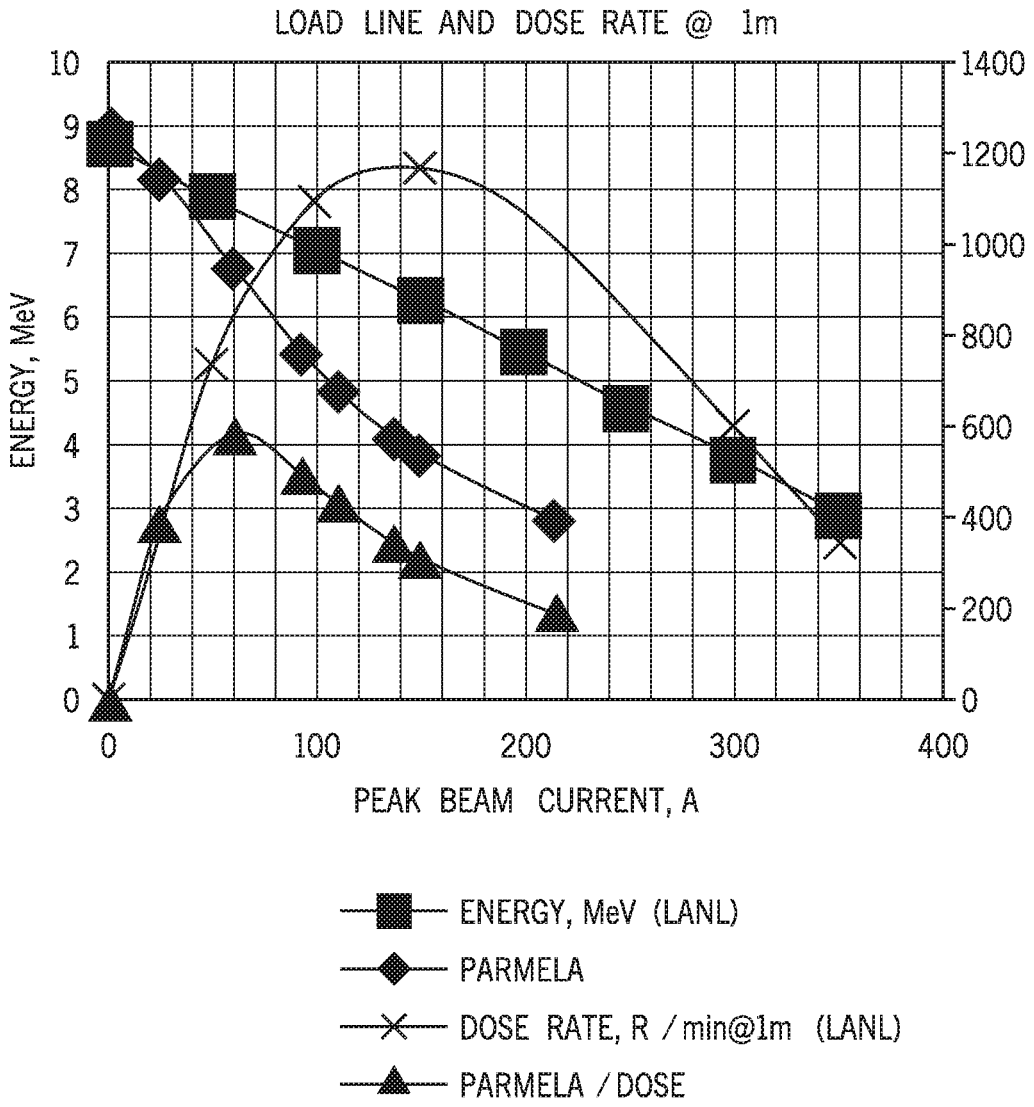
FIG. 2 is a graph of Electron Beam Energy vs. Peak Electron Beam Current showing changes to the LINAC load line (squares), in comparison with a corrected version based on Parmela simulations of beam dynamic (diamonds), and corresponding dose rate plots (X's and triangles, respectively) in a non-adapted standard single section LINAC, such as reduction of electron beam current and produced dose rate (if X-ray target is installed to produce bremsstrahlung) in a broad energy range due to effects of electron beam dynamics affected by changes in the accelerating RF field distribution in this energy range.
Figure 3:
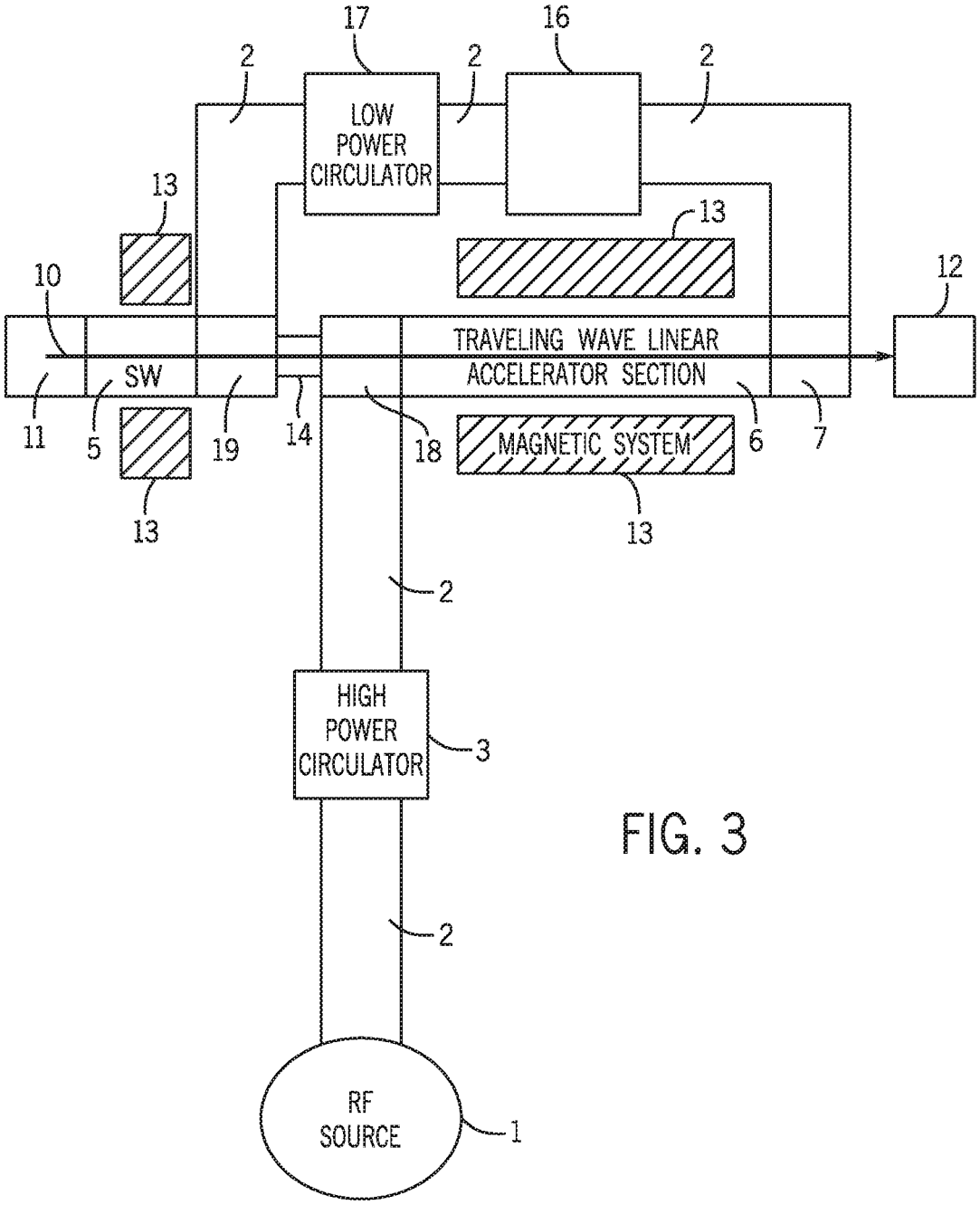
FIG. 3 is a schematic diagram of an embodiment of the hybrid LINAC of the invention, where an RF power circuit (which includes all elements (1, 2, 3, 18, 14, 19, 5) from RF source (1) to SW Buncher (5)) is configured in series with a "reversed" sequence (6, 18, 14, 19, 5), starting from the TW accelerating section (6) and continuing ultimately into the SW Buncher portion (5), the SW Buncher (5) serving as a final dissipating resonant RF load utilizing RF power productively for formation of the electron beam (10) in the SW buncher.

In an embodiment of the present invention shown in FIG. 3, RF power from the RF Power Source (1) propagates through an RF Transmitting Waveguide (2) via an optional High Power Circulator (3) (used at the RF power source, where propagating power is at its highest value) into the TW Input RF Coupler (18) of the TW Linear Accelerator Section (6). The TW Linear Accelerator Section (6) is RF-decoupled from a Standing Wave Buncher (5) by a Drift Space (14). While the RF Power Source (1) can run RF power into the TW Input RF Coupler (18) without an isolating device in steady state mode, a High Power Circulator (3), installed between the RF Power Source (1) and the TW Input RF Coupler (18), is desirable.

The RF Couplers (19, 18, 7) are configured to match impedance of the external and internal RF circuit so as to minimize power reflections at the operating RF frequency while running at nominal energy and beam current values. The High Power Circulator (3) prevents reflected power from propagating back to the RF source (1). Therefore, most or all of the RF power from the RF Power Source (1) enters the TW Input RF Coupler (18), propagates within the TW LINAC Section (6), thereby forming an accelerating TW field distribution, and is also transferred to the electron beam. The remaining power, which exits through TW Output RF Coupler (7) is transmitted into the SW Buncher (5) through the RF Transmitting Waveguide (2), connecting Switch and/or Phase Shifter and/or Power adjuster (16) and optional Low Power Circulator (17) (installed after the propagating power has become much lower than right after the magnetron due to some reflections, attenuation in the TW LINAC, and power consumed by the electron beam), then entering the SW Buncher (5) through the SW Input RF coupler (19).

Thus, the Hybrid LINAC of the invention is divided into two parts—the Standing Wave (SW) Buncher (5) and the Traveling Wave (TW) Accelerating Section (6), with Reverse Feeding Sequence (RFS) via the RF Transmitting Waveguide (2), Switch and/or Phase Shifter, and/or Power Adjuster (16) and the optional Low Power Circulator (17), such that the SW Buncher (5) is fed with RF power remaining after attenuation and e-beam acceleration in the TW section (6), thereby increasing the efficiency of the LINAC.

The Magnetic System (13), such as an external focusing solenoid or a permanent periodic magnet (PPM) system, is optional. The Magnet System (13) is preferably omitted, because including it increases complexity, power consumption, and consequently increases the cost of the LINAC system. Simulations of several specific examples demonstrated that use of an external focusing system (13) will improve current transmission by only 20% or similar percentage, while adequate characteristics of electron beam can be achieved without the use of such a system (13).

Electron beam energy and other output characteristics are regulated by means of changing phase and/or power by the Switch and/or Phase Shifter and/or Power Adjuster (16) installed in the RF Transmitting Waveguide (2) between the TW Output RF Coupler (7) and the SW Output RF Coupler (19), which may include at least one of: a switch, a fast and/or slow phase shifter, and a power regulator (16). Use of a Power Adjuster may be combined with regulation of beam current and/or input power so as to optimize the output RB characteristics. The electron beam current and the RF power can be optimally adjusted for each desired set of operating parameters. Along the RF Transmitting Waveguide (2), after the Switch and/or Phase Shifter and/or Power Adjuster (16) there may be an optional Low Power Circulator (17) installed, which is not critical to system operation, but may improve its performance, in certain aspects.

This combination of the SW and TW sections exploits several advantages of both. For example, the main operational frequency of the LINAC is largely defined by the SW buncher (5), while the TW section (6) is more broadband and is easily tuned to the required resonance frequency of the SW buncher (5). Therefore, the Automatic Frequency Control (AFC) is based on the SW buncher section (5), which is common for the SW LINACS, and it is a straightforward, proven configuration, while if it is only based on the TW section, the AFC is much more complex so as to ensure steady operation of the LINAC. The SW buncher section (5) permits effective RF focusing of the electron beam while reaching the relativistic speed, and further acceleration in the TW section (6) can also be done without any external magnetic system, as we described earlier.

Exploring a design example at 9300 MHz, using a PM-1110X X-band magnetron manufactured by L-3, the design parameters for a 60 cm long hybrid RF structure have shown to be superior to the existing non-hybrid configurations with similar characteristics, delivering a steady beam at energy in broad energy range of 1 MeV to 7 MeV, with a maximum output dose rate of 1100 R/min at 1 m, which corresponds to over 1700 R/min @ 80 cm, while delivering a substantial dose rate at low energy, estimated in tens of R/min at 1 m. Such a compact LINAC system with record high radiation beam characteristics can find its applications useful in many fields, such as Non-Destructive Testing (NDT), Security Screening (SI), Radiation Therapy (RT), etc.

Figure 4:
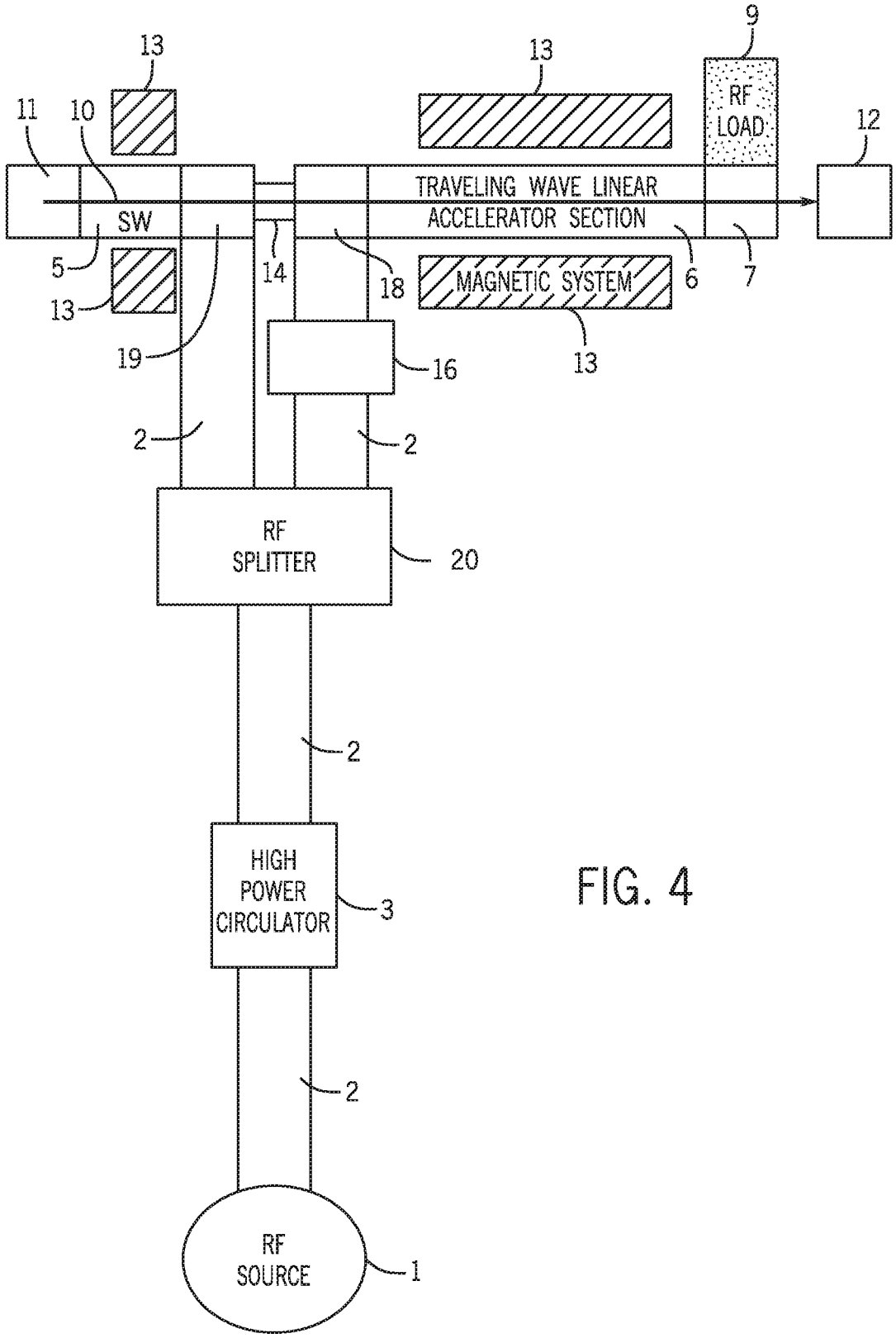
FIG. 4 is a schematic diagram of another embodiment of the hybrid LINAC of the invention with broad energy regulation, this embodiment having a variable RF Splitter (20) cooperative with a parallel RF feed (##) that includes at least one of: a switch, a phase shifter, and a power adjuster (15).

Referring to FIG. 4, in another embodiment of the invention, the hybrid LINAC structure includes a parallel feed. In this configuration, the RF Source (1) provides RF power through an RF Transmitting Waveguide (2), via a High Power Circulator (3), which is then split by the RF splitter (20). A portion of the RF power determined by the dividing ratio of the RF Splitter (20) is forwarded to the SW Output RF Coupler (19), and the remaining power is forwarded through the second arm of the RF Splitter (20) to the TW Input RF Coupler (18) through the Switch/Phase-shifter (16) similar to that used in the preferred embodiment described in FIG. 3.

In the embodiment of FIG. 4, RF power remaining after acceleration in Traveling Wave Linear Accelerator Section (6) is forwarded to and absorbed by the matched RF load (9). The embodiment of FIG. 4 is not as efficient as the embodiment of FIG. 3. For example, using the similar PM-1100X magnetron based design example, the LINAC output dose rate of the embodiment of FIG. 4 will be approximately 10% less than in the case of the embodiment of FIG. 3, while maintaining the other qualities of the embodiment of FIG. 3.

Figure 5:
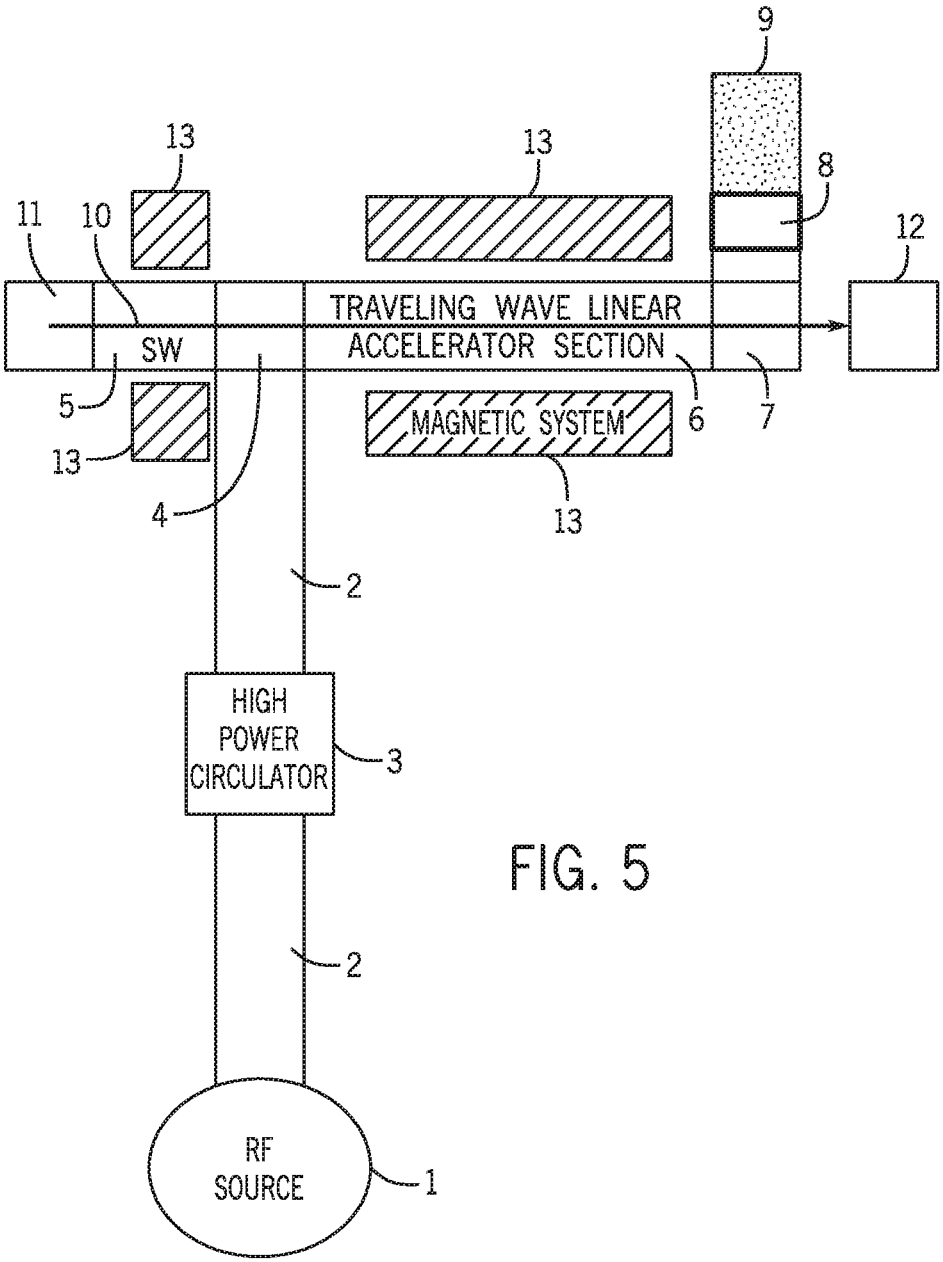
FIG. 5 is a schematic diagram of another embodiment of the hybrid LINAC of the invention having a single input RF coupler (4) and a matched RF load (9) cooperative with the TW Output Coupler (7) via an optional RF Switch (8).

With reference to FIG. 5, in another embodiment of the present invention, a Hybrid Input RF Coupler (4) serves as a combined single RF power input for both the SW and TW sections. The radiation beam parameter RF Switch (8) can be installed at the RF output of the TW section, right after the TW Output RF Coupler (7), and before the matched RF Load (9).

Other modifications and implementations will occur to those skilled in the art without departing from the spirit and the scope of the invention as claimed. Accordingly, the above description is not intended to limit the invention, except as indicated in the following claims.

What is claimed is:

1. A Hybrid LINAC with high beam efficiency and broad energy regulation for security inspection, non-destructive testing, radiotherapy, and electron beam irradiation of objects, the Hybrid LINAC comprising:

an electron gun configured to provide an input beam of electrons;

a standing wave linear accelerator section (SW Buncher) configured to receive the input beam of electrons and accelerate the electrons, the SW Buncher including an SW Input RF Coupler, the SW Buncher providing an intermediate beam of accelerated electrons;

a traveling wave linear accelerator section (TW accelerator) configured to receive the intermediate beam of accelerated electrons, and to further increase the momentum and energy of the accelerated electrons, the TW accelerator including a TW Input RF Coupler and a TW Output RF Coupler, the TW accelerator providing an output beam of electrons;

a drift space configured to provide RF decoupling between the SW buncher and the TW accelerator, while also permitting transit of the intermediate beam of accelerated electrons from the SW buncher to the TW accelerator;

an RF source configured to provide RF energy to the TW accelerator via a first RF Transmitting Waveguide and the TW Input RF Coupler; and a second RF Transmitting Waveguide including at least one of: a Switch, a Phase Shifter, and a Power Adjuster, the second RF Transmitting Waveguide being cooperative with both the TW Output RF Coupler and the SW Input RF Coupler, the second RF Transmitting Waveguide allowing the SW Buncher to serve as an adjustable resonant load so as to provide broad energy regulation of the output beam of electrons, the second RF Transmitting Waveguide also enabling the SW Buncher to be fed with RF power remaining after attenuation in the TW accelerator so as to provide high beam efficiency of the output beam of electrons.

2. The Hybrid LINAC of claim 1, wherein the standing wave linear accelerator section (SW Buncher) is cooperative with a first external magnetic system.

3. The Hybrid LINAC of claim 1, wherein the traveling wave linear accelerator section (TW accelerator) is cooperative with a second external magnetic system.

4. The Hybrid LINAC of claim 1, wherein the first RF Transmitting Waveguide includes a High Power Circulator so as to prevent reflected RF power from propagating back to the RF source.

5. The Hybrid LINAC of claim 1, wherein the second RF Transmitting Waveguide includes a Low Power Circulator so as to prevent reflected RF power from propagating back to the TW accelerator.

6. The Hybrid LINAC of claim 1, wherein broad energy regulation of the output beam of electrons provides energy regulation from 0.5 MeV to maximum LINAC energy.

7. The Hybrid LINAC of claim 1, further comprising at least one of:

an electron beam window and a conversion target for producing Bremsstrahlung radiation.

8. A Hybrid LINAC with high beam efficiency and broad energy regulation for security inspection, non-destructive testing, radiotherapy, and electron beam irradiation of objects, the Hybrid LINAC comprising:

an electron gun configured to provide an input beam of electrons;

a standing wave linear accelerator section (SW Buncher) configured to receive the input beam of electrons and accelerate the electrons, the SW Buncher including an SW Input RF Coupler, the SW Buncher providing an intermediate beam of accelerated electrons;

a traveling wave linear accelerator section (TW accelerator) configured to receive the intermediate beam of accelerated electrons, and to further increase the momentum and energy of the accelerated electrons, the TW accelerator including a TW Input RF Coupler and a TW Output RF Coupler, the TW accelerator providing an output beam of electrons;

a drift space configured to provide RF decoupling between the SW buncher and the TW accelerator, while also permitting transit of the intermediate beam of accelerated electrons from the SW buncher to the TW accelerator;

an RF Splitter configured to receive RF energy, and to bifurcate the RF energy;

an RF source configured to provide RF energy to the RF splitter via a first RF Transmitting Waveguide, the RF Splitter providing a first portion of the bifurcated RF energy to the SW Buncher via a second RF Transmitting Waveguide and the SW Input RF Coupler, the second RF Transmitting Waveguide also enabling the SW Buncher to be fed with RF power not used by the TW Accelerator so as to provide high beam efficiency of the output beam of electrons; and at least one of a Switch, a Phase Shifter, and a Power Adjuster, cooperative with both the RF Splitter and the TW Input RF Coupler via a third RF Transmitting Waveguide, the at least one of a Switch, a Phase Shifter, and a Power Adjuster being capable of redistributing RF power between the SW Buncher and the TW Accelerator, and/or changing phase relationship between the SW Buncher and the TW Accelerator, thereby allowing the TW Accelerator to serve as an adjustable resonant load so as to provide broad energy regulation of the output beam of electrons.

9. The Hybrid LINAC of claim 8, wherein the standing wave linear accelerator section (SW Buncher) is cooperative with a first external magnetic system.

10. The Hybrid LINAC of claim 8, wherein the traveling wave linear accelerator section (TW accelerator) is cooperative with a second external magnetic system.

11. The Hybrid LINAC of claim 8, wherein the first RF Transmitting Waveguide includes a High Power Circulator so as to prevent reflected RF power from propagating back to the RF source.

12. The Hybrid LINAC of claim 8, further comprising:

a Matched RF Load, cooperative with the TW Output RF Coupler, matched so as to absorb RF power remaining after acceleration in the TW Accelerator.

13. The Hybrid LINAC of claim 8, wherein broad energy regulation of the output beam of electrons provides energy regulation from 0.5 MeV to maximum LINAC energy.

14. The Hybrid LINAC of claim 8, further comprising at least one of:

an electron beam window and a conversion target for producing Bremsstrahlung radiation.

15. A Hybrid LINAC with high beam efficiency and broad energy regulation for security inspection, non-destructive testing, radiotherapy, and electron beam irradiation of objects, the Hybrid LINAC comprising:

an electron gun configured to provide an input beam of electrons;

a standing wave linear accelerator section (SW Buncher) configured to receive the input beam of electrons and accelerate the electrons, the SW Buncher providing an intermediate beam of accelerated electrons;

a traveling wave linear accelerator section (TW accelerator) configured to receive the intermediate beam of accelerated electrons, and to further increase the momentum and energy of the accelerated electrons, the TW accelerator including a TW Output RF Coupler, the TW accelerator providing an output beam of electrons;

a Hybrid RF Coupler configured to provide RF coupling between the SW buncher and the TW accelerator, while also permitting transit of the intermediate beam of accelerated electrons from the SW buncher to the TW accelerator;

an RF source configured to provide RF energy to both the SW Buncher and the TW accelerator via an RF Transmitting Waveguide cooperative with the Hybrid RF Coupler; and a Matched RF Load cooperative with at least one of a Switch, a Phase Shifter, and a Power Adjuster, the Matched RF Load also being cooperative with the TW Output RF Coupler, the Matched RF Load being matched so as to absorb RF power remaining after acceleration in the TW Accelerator in accordance with the at least one of the Switch, the Phase Shifter, and the Power Adjuster, thereby allowing the TW Accelerator to serve as an adjustable resonant load so as to provide broad energy regulation of the output beam of electrons, and so as to provide high beam efficiency of the output beam of electrons.

16. The Hybrid LINAC of claim 15, wherein the standing wave linear accelerator section (SW Buncher) is cooperative with a first external magnetic system.

17. The Hybrid LINAC of claim 15, wherein the traveling wave linear accelerator section (TW accelerator) is cooperative with a second external magnetic system.

18. The Hybrid LINAC of claim 15, wherein the first RF Transmitting Waveguide includes a High Power Circulator so as to prevent reflected RF power from propagating back to the RF source.

19. The Hybrid LINAC of claim 15, wherein broad energy regulation of the output beam of electrons provides energy regulation from 0.5 MeV to maximum LINAC energy.

20. The Hybrid LINAC of claim 15, further comprising at least one of:

an electron beam window and a conversion target for producing Bremsstrahlung radiation.

* * * * *